United States Patent [19]

Lyng

[11] Patent Number: 4,971,088

[45] Date of Patent: Nov. 20, 1990

[54] ANTI-SLIP CAP

[76] Inventor: John J. Lyng, 112 Maple St., Hornell, N.Y. 14843

[21] Appl. No.: 319,298

[22] Filed: Mar. 6, 1989

[51] Int. Cl.[5] ..... A42B 7/00

[52] U.S. Cl. ..... 135/65; 135/86

[58] Field of Search ..... 135/65, 77, 86, 70

[56] References Cited

U.S. PATENT DOCUMENTS

| | | | |
|---|---|---|---|
| 1,329,915 | 2/1920 | Nckenzie | 135/65 |
| 1,556,966 | 10/1925 | Selig | 135/77 X |
| 2,116,941 | 5/1938 | Francis | 135/86 X |
| 2,192,040 | 2/1940 | Harns | 135/77 |
| 2,192,097 | 2/1940 | Nicholson | 135/77 |
| 3,199,819 | 8/1965 | Widmark | 135/77 X |
| 3,229,738 | 1/1966 | Bianchini | 135/77 X |
| 3,467,117 | 9/1969 | Lucibello | 135/77 |
| 4,730,632 | 3/1988 | Mace | 135/76 |
| 4,794,743 | 1/1989 | Lehneis | 135/65 |

FOREIGN PATENT DOCUMENTS

| | | | |
|---|---|---|---|
| 963349 | 12/1949 | France | 135/86 |

*Primary Examiner*—Carl D. Friedman
*Assistant Examiner*—Caroline D. Dennison

[57] ABSTRACT

In accordance with the present invention, an apparatus for preventing the slippage of a cane-like handle is provided, the apparatus including an interior portion and an exterior portion. The interior portion is formed of an anti-skid material for gripping the cane-like handle. The exterior portion is also formed of the anti-skid material, the interior and the exterior portions being cup-shaped, with an open end and a spherically-shaped closed end. A plurality of protuberances are formed on the exterior portion of the apparatus to deter slipping of the cane-like handle.

13 Claims, 1 Drawing Sheet

FIG. 1
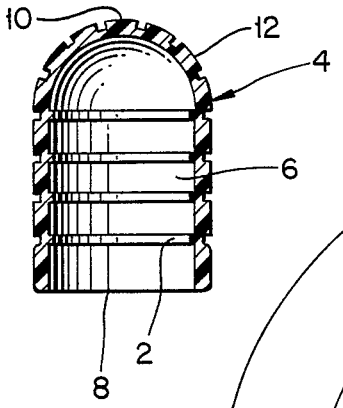
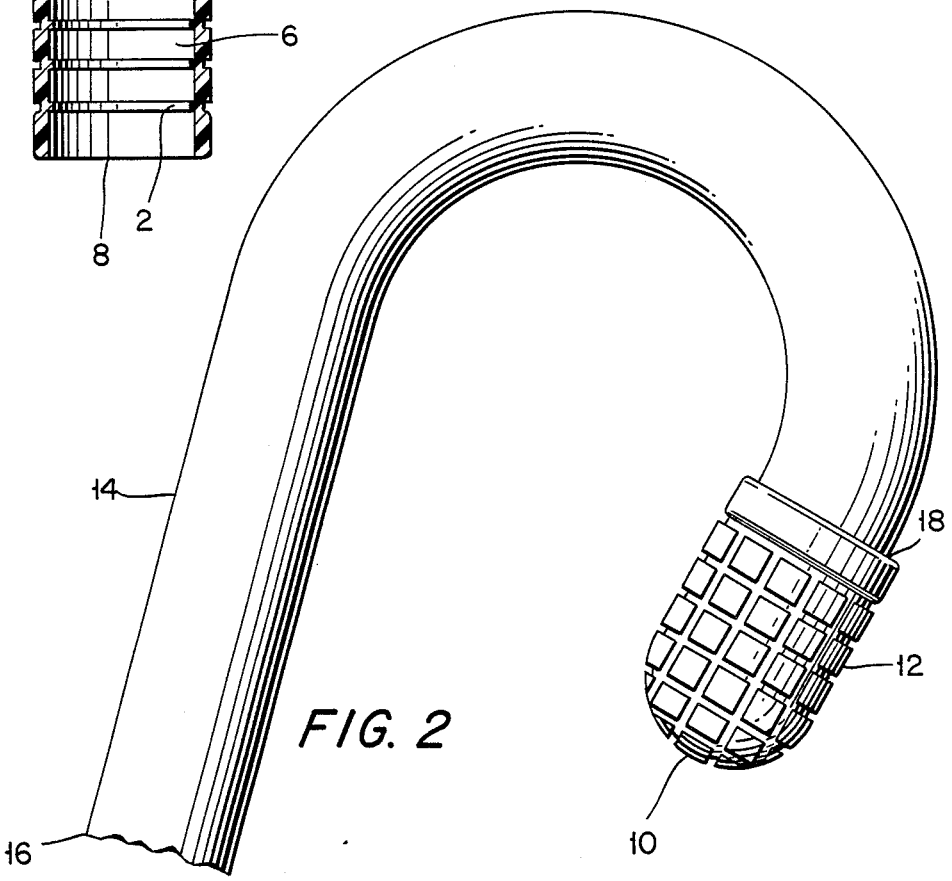
FIG. 2
FIG. 3
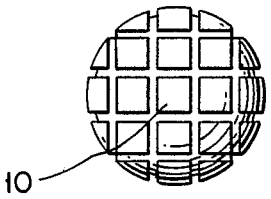
FIG. 4
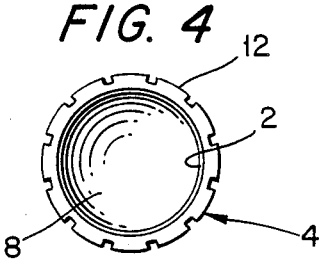

ANTI-SLIP CAP

BACKGROUND OF THE INVENTION

The present invention generally relates to an apparatus for deterring slippage of an object. More specifically, the present invention relates to an apparatus which can be attached to the handle portion of an object, such as a cane, umbrella or the like, to prevent the object from slipping off a surface.

In the past, various devices have been implemented for holding an object, such as an umbrella or cane, in place on a planar surface. For example, in U.S. Pat. No. 1,329,915 (McKenzie), an attachment is disclosed which may be temporarily or permanently affixed to the handle of an umbrella for engaging the upper surface of a table or other support when the umbrella is being supported by its handle on the table or other support. The attachment is intended to hold the umbrella in place on the support surface without injuring the umbrella or the surface.

Such a holding device could be used to keep the object within the convenient reach of its user. This feature is especially important to, for example, a partially disabled user of a cane. Such a person would likely have difficulty reaching to the ground to lift a cane which has fallen over or slipped off a table top. An effort to reach for the cane could cause the already compromised cane user to lose balance, and incur serious physical injury.

One drawback of the known devices is that they must be specially manufactured for the particular object to which they are attached. Accordingly, the usefulness of such known devices is limited. That is, because additional manufacturing expenses are associated with the production of a wide variety of device sizes and shapes to accommodate a variety of object shapes, the manufacture of these useful devices is commercially impractical.

Thus, a need exists for an anti-slip apparatus which would be inexpensive to manufacture and which would be universally applicable to the handle end of objects such as canes, umbrellas and the like for preventing slippage of the objects off planar surfaces such as table tops.

SUMMARY OF THE INVENTION

Accordingly, it is an object of the present invention to overcome the deficiencies described above by providing a novel apparatus for preventing slippage of the handle end of an object which has been dangled off a table top or other planar surface.

It is a further object of the present invention to provide a novel anti-slip apparatus which is inexpensive to manufacture, and which can be readily attached to objects having a variety of sizes and shapes, and being constructed of any number of different materials.

In accordance with the present invention, an apparatus for preventing the slippage of a cane-like handle is provided, the apparatus including an interior portion and an exterior portion. The interior portion is formed of an anti-skid material for gripping the cane-like handle. The exterior portion is also formed of the anti-skid material, the interior and the exterior portions being cup-shaped, with an open end and a spherically-shaped closed end. A plurality of protuberances are formed on the exterior portion of the apparatus to deter slipping of the cane-like handle.

In further accordance with the invention, an apparatus is provided which includes a shaft having first and second free ends, one of said free ends being formed as a handle. The apparatus further includes a means for deterring slippage of the handle, the deterring means having a cup-shaped form. A means is also provided for attaching the deterring means to the handle, the deterring means including a plurality of protuberances formed of anti-skid material and located about the surface of said deterring means.

BRIEF DESCRIPTION OF THE DRAWINGS

Other objects and advantages will become apparent from the following detailed description of preferred embodiments of the invention as described in conjunction with the accompanying drawings wherein like reference numerals are applied to like elements and wherein:

FIG. 1 is a cross-sectional view of one embodiment of the invention;

FIG. 2 is a side elevation of the FIG. 1 embodiment, shown in place on an object such as a cane handle;

FIG. 3 is a top view of the FIG. 1 embodiment; and,

FIG. 4 is a bottom view of the FIG. 1 embodiment.

DETAILED DESCRIPTION OF THE PREFERRED EMBODIMENTS

Referring to FIG. 1, an exemplary preferred embodiment of an apparatus for preventing slippage of a cane-like object in accordance with the present invention is shown in an approximately one-to-one scale. In the following description of preferred embodiments of the present invention, particular reference is made to the attachment of the disclosed apparatus to a cane-like handle to provide a practical illustration of the features and advantages which the present invention offers. It will be appreciated, however, that the invention can be utilized with any other similar objects, such as the handle end of an umbrella or the like, to deter or prevent slippage.

The term handle in this sense is taken to mean any portion of an object which is typically placed into contact with a planar surface such that the object is dangled over the edge of the surface, and is not intended to be limited to handles per se. Furthermore, the exact shape of the handle end of an object to which the disclosed apparatus is attached is not limited, and can for example include a curved handle, a straight handle or the like. Similarly, the object to which the disclosed apparatus is attached can be made of virtually any rounded, dense material, such as wood, metal or plastic.

As shown in FIG. 1, the apparatus of the present invention includes an interior portion 2 formed of anti-skid or anti-slip material. In a preferred embodiment, the anti-skid material is a flexible material such as latex rubber. In addition, the interior portion of the preferred embodiment is rib-shaped with the ribs 6 being fashioned to permit the interior portion of the apparatus to adapt to various shaped objects and to provide significant holding power in maintaining the FIG. 1 apparatus on an object handle. Although the exact width and spacing of the ribs, as shown in the Figures, are considered sufficient to provide adequate flexibility and holding power for the interior portion, these dimensions are intended to be purely exemplary. It would, for example, be apparent that by increasing the spacing between the ribs 6 the flexibility of the interior portion could be altered. Similarly, by adjusting the width of the ribs themselves, the surface area of the interior portion which would contact an object could be altered.

The FIG. 1 apparatus further includes an exterior portion 4 formed of the anti-skid material. The interior and exterior portions of the apparatus are cup-shaped with an open end 8 and a closed end 10 opposite the open end. In a preferred embodiment, at least a portion of the closed end is spherical in shape to, for example, permit universal application of the disclosed apparatus to a variety of objects. In addition, the spherical shaped configuration provides significant holding power against any surface with which it is engaged, thereby deterring or preventing slippage.

A plurality of protuberances 12 are formed on the exterior portion of the apparatus to again permit universal application of the apparatus to a variety of object sizes and shapes and to provide substantial holding power against any surface which the exterior portion of the apparatus contacts. The number and size of protuberances shown in the Figures is considered sufficient to provide an adequate amount of holding power and adaptability of the apparatus to various sizes and shapes of surfaces. However, it should be noted that the present invention is not limited to the exact size and shape of the protuberances shown in the Figures. For example, it would be apparent to any person skilled in the art that by changing the number and size of protuberances used on the exterior portion, the flexibility and holding power of the exterior portion could be altered to accommodate specific needs.

Referring now to FIG. 2, a shaft 14 having first and second free ends 16 and 18 is shown, with the free end 18 being formed as a handle 20. A means for deterring slippage of the shaft, such as the apparatus of FIG. 1, is also shown in FIG. 2. Means are further provided for attaching the deterring means to the handle 20 of the shaft, such as the ribs 6 of the interior portion described with respect to the FIG. 1 apparatus. It should be noted, however, that the means for attaching could alternatively be represented as ribs 6 formed on the handle portion 20 at the free end 18. In addition, any known adhesive could be used between the interior portion 6 and the free end of the handle 20 to more permanently affix the deterring means to the handle. Returning now to FIG. 2, it can be seen that because the shape of the flexible exterior portion 4 may be influenced by the shape of the free end 18 to which the deterring means is attached, the shape of each protuberance 12 may be determined by its location on the exterior portion.

FIG. 3 represents a top view of the FIG. 1 apparatus, and reflects the spherical nature of at least a portion of the closed end 10. FIG. 3 also indicates the criss-cross pattern of protuberances used in a preferred embodiment of the present invention. It should, however, be readily apparent to one skilled in the art that any pattern of protuberances which would provide flexibility of the FIG. 3 deterring means could be used with the present invention.

FIG. 4 represents a bottom view of the FIG. 1 apparatus, wherein both the interior and the exterior portions of the FIG. 1 apparatus can be seen via the open end 8.

It will be appreciated by those skilled in the art that the present invention can be embodied in other forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Apparatus for preventing slippage of a cane-like handle comprising:
   - an interior portion formed of anti-skid material for gripping the cane-like handle;
   - an exterior portion formed of said anti-skid material, said interior and exterior portions being cup-shaped with an open end and a spherically shaped closed end; and,
   - a plurality of protuberances formed on said exterior portion to deter slipping of the cane-like handle.

2. Apparatus of claim 1, wherein said interior portion is formed with a plurality of ribs.

3. Apparatus of claim 1, wherein the shape of each of said protuberances is determined by its location on the exterior of the deterring means.

4. Apparatus of claim 1, wherein said anti-skid material is flexible.

5. Apparatus of claim 4, wherein said flexible anti-skid material is latex rubber.

6. An apparatus comprising:
   - a shaft having first and second free ends, one of said first and second free ends being formed as a handle;
   - means for deterring slippage of said handle, said deterring means having a cup-shaped form with a spherically exterior surface; and,
   - means for attaching said deterring means to said handle, said deterring means further including:
     - a plurality of protuberances formed of anti-skid material and located about said spherically-shaped exterior surface of said deterring means.

7. Apparatus of claim 6, wherein said means for attaching is formed as ribs on an interior of said cup-shaped deterring means.

8. Apparatus of claim 6, wherein said attaching means is an adhesive placed between the interior of said cup-shaped deterring means and the handle.

9. Apparatus of claim 6, wherein said cup-shaped deterring means has an open end and a closed end opposite said open end, at least a portion of said closed end being spherically shaped.

10. Apparatus of claim 6, wherein said shaft and said handle form a cane.

11. Apparatus of claim 6, wherein said deterring means is formed of a flexible, anti-skid material.

12. Apparatus of claim 11, wherein the shape of each protuberance is determined by its location on the exterior of the deterring means which has been attached to said handle.

13. Apparatus of claim 11, wherein said flexible, anti-skid material is latex rubber.

* * * * *